US009404202B2

(12) United States Patent
Lawrence et al.

(10) Patent No.: US 9,404,202 B2
(45) Date of Patent: Aug. 2, 2016

(54) CARBON FIBRE YARN AND METHOD FOR THE PRODUCTION THEREOF

(75) Inventors: Carl Anthony Lawrence, Leeds (GB); Simon Brian Havis, Leeds (GB); Mahmudul Akonda, Wakefield (GB)

(73) Assignee: University of Leeds, Leeds (GB)

( * ) Notice: Subject to any disclaimer, the term of this patent is extended or adjusted under 35 U.S.C. 154(b) by 436 days.

(21) Appl. No.: 13/577,141

(22) PCT Filed: Feb. 7, 2011

(86) PCT No.: PCT/GB2011/050208

§ 371 (c)(1),
(2), (4) Date: Oct. 10, 2012

(87) PCT Pub. No.: WO2011/095826

PCT Pub. Date: Aug. 11, 2011

(65) Prior Publication Data

US 2013/0192189 A1 Aug. 1, 2013

(30) Foreign Application Priority Data

Feb. 5, 2010 (GB) ..... 1001868.7

(51) Int. Cl.
*D02G 3/16* (2006.01)
*D01G 1/10* (2006.01)
(Continued)

(52) U.S. Cl.
CPC .. *D02G 3/16* (2013.01); *D01G 1/10* (2013.01); *D01G 13/00* (2013.01); *D01G 15/00* (2013.01); *D01G 15/84* (2013.01); *D01G 19/06* (2013.01); *D02G 3/04* (2013.01); *D10B 2101/12* (2013.01)

(58) Field of Classification Search
CPC ..... D02G 3/04; D02G 3/16; D01G 1/10; D01G 13/00
USPC ..... 57/243, 244, 252
See application file for complete search history.

(56) References Cited

U.S. PATENT DOCUMENTS 4,299,884 A * 11/1981 Payen ..... D02G 3/385 428/377
4,520,623 A * 6/1985 Ogawa et al. ..... 57/236
(Continued)

FOREIGN PATENT DOCUMENTS

DE 10 2009 023529 A1 12/2010
EP 0 274 970 A1 7/1988
(Continued)

OTHER PUBLICATIONS

Steven Warner, Textile Science, 1995, Prentice Hall, p. 40.*
(Continued)

*Primary Examiner* — Shaun R Hurley
(74) *Attorney, Agent, or Firm* — Harness, Dickey & Pierce, P.L.C.

(57) ABSTRACT

The invention provides a spun yarn comprising recycled carbon fiber, and a method for the production thereof. The recycled carbon fiber comprises discontinuous carbon fiber and, optionally, continuous carbon fiber, and may be recycled from various sources, such as end-of-life waste and manufacturing waste. The yarn which is produced shows the required degree of strength and durability, and can be used in all conventional composite manufacturing operations where virgin yarn is currently employed, such as woven fabric manufacture, unidirectional fabric manufacture, filament winding, pultrusion and the like.

30 Claims, 2 Drawing Sheets

STATIONARY (FIXED) FLATS CARD

(51) Int. Cl.

| | |
|---|---|
| ***D01G 13/00*** | (2006.01) |
| ***D01G 15/00*** | (2006.01) |
| ***D01G 15/84*** | (2006.01) |
| ***D01G 19/06*** | (2006.01) |
| ***D02G 3/04*** | (2006.01) |

(56) References Cited

U.S. PATENT DOCUMENTS

| | | | | |
|---|---|---|---|---|
| 4,714,642 | A * | 12/1987 | McAliley et al. | 428/113 |
| 4,825,635 | A | 5/1989 | Guevel et al. | |
| 4,850,186 | A * | 7/1989 | Hiramatsu et al. | 57/236 |
| 5,206,085 | A * | 4/1993 | Nakagawa et al. | 428/372 |
| 5,217,770 | A | 6/1993 | Morris, Jr. et al. | |
| 5,312,660 | A * | 5/1994 | Morris et al. | 428/36.3 |
| 5,331,801 | A * | 7/1994 | Heifetz | 57/400 |
| 5,464,684 | A * | 11/1995 | Vogelsang | D02G 3/402 428/373 |
| 5,519,925 | A * | 5/1996 | Ball et al. | 28/299 |
| 7,610,743 | B2 * | 11/2009 | Kobayashi et al. | 57/252 |
| 7,634,840 | B2 | 12/2009 | Kobayashi et al. | |
| 8,171,711 | B2 * | 5/2012 | Kobayashi et al. | 57/210 |
| 2007/0145620 | A1 * | 6/2007 | Kobayashi et al. | 264/29.2 |
| 2007/0169458 | A1 * | 7/2007 | Schwung | D02G 3/38 57/210 |
| 2008/0152906 | A1 * | 6/2008 | Kobayashi et al. | 428/367 |
| 2008/0307765 | A1 * | 12/2008 | Kobayashi et al. | 57/252 |

FOREIGN PATENT DOCUMENTS

| | | | |
|---|---|---|---|
| EP | 0 530 741 | A1 | 3/1993 |
| EP | 0 683 261 | A2 | 11/1995 |
| EP | 0 748 781 | A2 | 12/1996 |
| EP | 1 700 938 | A1 | 9/2006 |
| JP | H01133721 | A | 5/1989 |
| JP | 03-027122 | B2 | 2/1991 |
| JP | 05-193030 | B2 | 8/1993 |
| JP | 07243140 | | 2/1994 |
| JP | 06-298993 | | 10/1994 |
| JP | 3152748 | B2 | 4/2001 |
| JP | 2005-179809 | A | 7/2005 |
| JP | 2005 307121 | A | 11/2005 |
| JP | 2008-303872 | A | 12/2008 |
| WO | WO-9409972 | A2 | 5/1994 |
| WO | WO-9939031 | A1 | 8/1999 |
| WO | WO-2004033772 | | 4/2004 |
| WO | WO-2007058298 | A1 | 5/2007 |

OTHER PUBLICATIONS

"'Fibercycle' Project to Develop Affordable Carbon fiber Yarns and Fabrics Nears Completion", SpecialChem, May 20, 2011, XP002646345, Retrieved from the Internet: URL:http://www.specialchem4polymers.com/resources/latest/displaynews.aspx?id=6034&q=fibercycle.

"Low cost blended carbon fibre yarns and fabrics", Reinforced plastics, May 18, 2011, XP002646346, Retrieved from the Internet: URL:http://www.reinforcedplastics.com/view/18013/low-cost-blended-carbon-fibre-yarns-and-fabrics.

International Search Report and Written Opinion for PCT/GB2011/050208, mailed Aug. 16, 2011; ISA/EP.

Great Britain Search Report for GB1001868.7; date of search May 19, 2010.

"Carbon recycling: a soluble problem", Reinforced Plastics, vol. 53, May 1, 2009 (Elsevier Advanced Technology, New York), G. Marsh—pp. 22-27 (XP026101027).

"Reclaiming value from post-use consumer composite", Reinforced Plastics, vol. 52, Jul. 1, 2008 (Elsevier Advanced Technology, New York), G. Marsh—pp. 36-39 (XP022853262).

"Handling and manipulation of composite materials", Composites, May 1, 1972 (IPC Business Press Ltd., Haywards Heath, GB), Conference report, Shirley Institute—pp. 130-137 (XP022837590).

Slide show entitled "Recycling solutions for cured and uncured carbon fibre composites", by MilledCarbon Ltd; dated Sep. 2007; found at Internet URL http://users.ox.ac.uk/-pgrant/Milled%20Carbon%2Oupdate.pdf.

Japanese Office Action (in English and Japanese) corresponding to JP2012-551693, drafted Mar. 25, 2015 and received by Japanese associate Mar. 31, 2015.

* cited by examiner

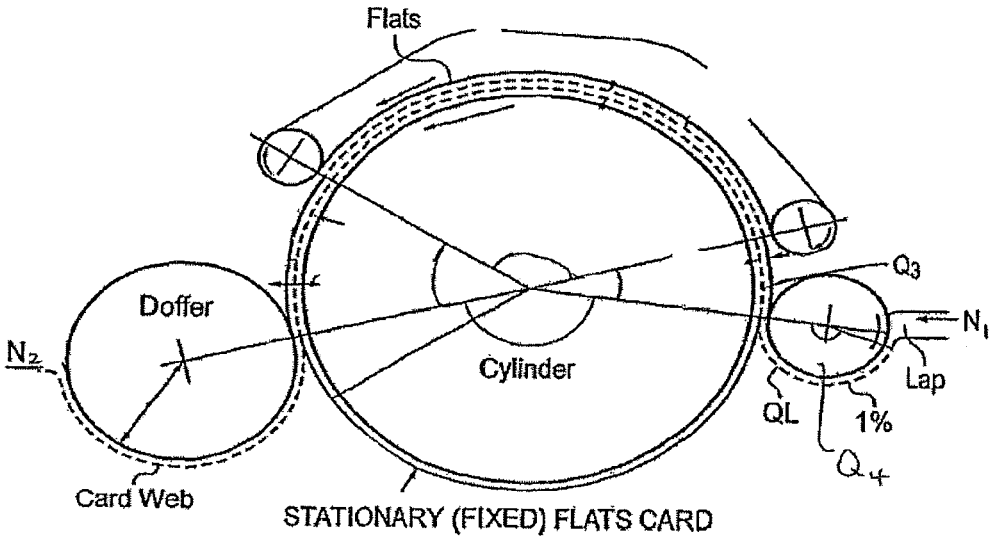
FIGURE 1 STATIONARY (FIXED) FLATS CARD
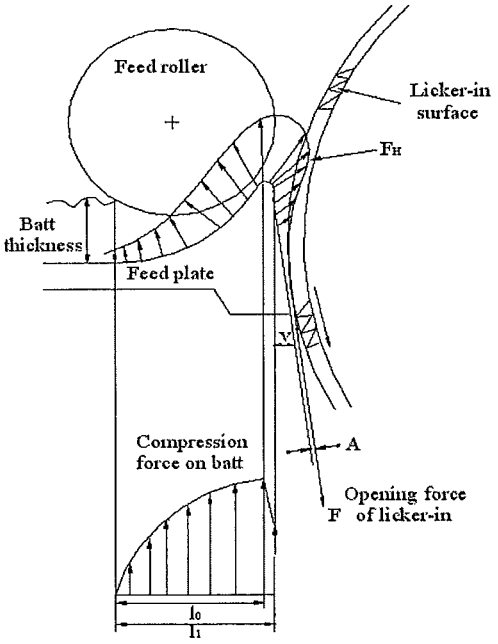
FIGURE 2 FEED SYSTEM

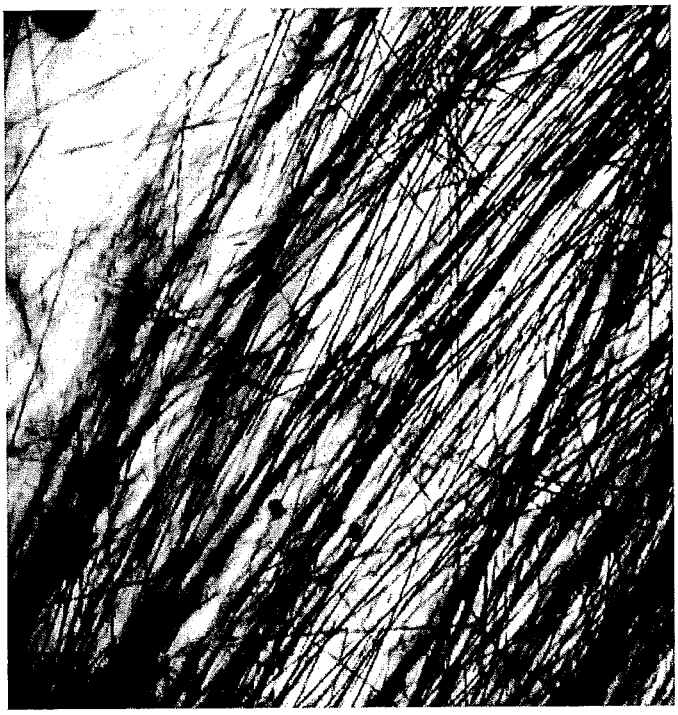
FIGURE 3 FIBRE ORIENTATION WITHIN THE CARDED SLIVER

CARBON FIBRE YARN AND METHOD FOR THE PRODUCTION THEREOF

CROSS-REFERENCE TO RELATED APPLICATIONS

This application is a 371 U.S. National Stage of International Application No. PCT/GB2011/050208, filed Feb. 7, 2011, and claims priority to British patent application No. 1001868.7, filed Feb. 5, 2010, the disclosures of which are herein incorporated by reference in their entirety.

FIELD OF THE INVENTION

This invention concerns a novel approach to the production of yarns from carbon fibres. Specifically, the invention provides spun yarns which are obtained from recycled carbon fibres, and methods for the production of these yarns.

BACKGROUND TO THE INVENTION

Carbon fibre has found widespread use in a variety of different applications as a consequence of its exceptional strength. For example, it is possible to form a yarn by twisting together a multiplicity of individual carbon fibres, and this yarn may, for instance, be woven into a fabric. Alternatively, the carbon fibre yarn may be combined with any of a number of plastics materials and wound or moulded to form a composite material such as a carbon fibre reinforced polymer; such materials have particularly high strength to weight ratios.

Carbon fibre also has the advantage of considerably lower density when compared with steel, and this makes it an ideal material for applications requiring low weight. The properties of carbon fibre, such as high tensile strength, low weight and low thermal expansion, make it especially useful in aerospace, civil engineering, military, and motor sports applications. However, it is in carbon fibre reinforced polymers that the material finds the most widespread use.

A great deal of prior art exists which details the preparation and use of carbon fibre-based materials. However, some drawbacks are associated with the use of such materials. Cost, for example, can be an issue in certain applications. Furthermore, at the end of their useful lives, many materials which comprise carbon fibres are currently disposed of at landfill sites, thereby adding to the global problems of waste disposal and creating further environmental problems.

The present inventors, therefore, have examined the possibility that such waste carbon fibre material might be recycled and put to further use, thereby generating lower cost materials and helping to avoid the problems of waste disposal which might otherwise arise. Surprisingly, it has been found that not only may these materials be efficiently recycled, but it is also possible to further process them so as to produce carbon fibre yarn which is especially useful in textile applications.

Whilst the prior art, as previously noted, includes many references to the production and uses of carbon fibre yarns, all of these applications require the use of virgin carbon fibre, i.e. material which is newly prepared for a particular application, and is generally supplied as a continuous filament. Prior art in which recycled materials are used is confined to the production of substrates such as discs and sheet materials. Thus, for example, EP-A-530741 discloses fibrous substrates for the production of carbon and/or ceramic fibre reinforced carbon and/or ceramic matrix composites, particularly friction discs, and methods of manufacture thereof. The possibility of offcut waste fibrous sheet material being recycled and reformed into a web useful in the manufacture of such composites is discussed.

Alternatively, WO-A-2007/058298 teaches a recycled composite material made from a waste product of an original composite material, wherein the original composite material comprises a matrix and a carbon fibre structure contained in the matrix, the carbon fibre structure having a three-dimensional network structure. The recycled composite material is produced by supplementing the waste product of the original composite material with a matrix which is same as, and/or different to, the matrix contained in the waste material, and then kneading the resulting mixture.

The prior art, however, is silent as to the possibility of providing carbon fibre yarn from recycled carbon fibre materials, and it is this deficiency that the present inventors seek to address. Whereas virgin carbon fibre yarn, commonly referred to as carbon fibre tow, comprises continuous filament material, the present invention is concerned with the production of carbon fibre yarn from discontinuous recycled carbon fibre materials. The materials which are produced show satisfactory strength and durability in a wide range of applications and are much cheaper to produce than counterpart materials made from virgin carbon fibre tow. In addition, the recycling of waste carbon fibre products in this way has considerable environmental benefits and has the potential to contribute significantly to the alleviation of waste disposal problems.

SUMMARY OF THE INVENTION

Thus, according to a first aspect of the present invention there is provided a spun yarn comprising recycled carbon fibre.

In the context of the present invention, recycled carbon fibre is taken to be carbon fibre which has been used for a previous application in a material which has reached the end of its useful life. The recycled carbon fibre comprises discontinuous carbon fibre and may be recycled from various sources, such as end-of-life waste and manufacturing waste by means of cutting or chopping of these materials. Optionally, the recycled carbon fibre may also include continuous carbon fibre.

Typically, said recycled carbon fibre comprises recycled virgin carbon fibre, which is recovered during manufacturing pipeline activities, and/or reclaimed carbon fibre waste, or recyclate, which comprises carbon fibre recovered from finished composites as end-of-life or manufacturing waste.

Said recycled carbon fibres may be obtained from any convenient source. Thus, virgin carbon fibre waste may, for example, be obtained from multi-axial fabric trim, weaving selvedge trim, fibre collected from machine extraction systems, chopped continuous tow, woven fabric and unidirectional fabric, whilst reclaimed carbon fibre waste (recyclate) includes fibre recovered from end-of-life and finished composite materials through removal of resin matrix by means of high temperature processing or other suitable means of separating resin matrix from carbon fibre.

Preferably, the spun yarn according to the first aspect of the invention additionally includes at least one other fibre, commonly referred to as a matrix fibre, which may be any natural or synthetic polymer, but preferably comprises at least one thermoplastic resin. Suitable thermoplastic resins may, for example, include polyalkenes such as polyethylene or polypropylene, polyesters such as polyethylene terephthalate or polybutylene terephthalate, polyamides, polyethersulphone polymers, or high performance fibres, examples of which include VECTRAN™, which is an aromatic polyester and is spun from a liquid crystal polymer, and polyaryletheretherketones from the PEEK™ range of polymers.

The recycled carbon fibre for use in this preferred embodiment can be of any length suitable for blending with the other fibres. Typically, said recycled carbon fibre will have a length in the range from 40-250 mm, but the most preferred length is 80 mm. The recycled carbon fibre content of the spun yarn can be from 0.1-99.9%, preferably 30-80%, by weight.

According to a second aspect of the present invention, there is provided a method for the production of a yarn comprising recycled carbon fibre, said method comprising the steps of:

(a) Cutting or chopping of a recycled carbon fibre material;
(b) When necessary, separating the carbon fibres from other materials present in the recycled carbon fibre material;
(c) Opening and blending of the fibres;
(d) Intermingling the fibres; and
(e) Forming a yarn.

Optionally, when required, said process additionally comprises the step of straightening the fibres, this step being performed after intermingling the fibres, and prior to forming a yarn.

The process of intermingling the fibres is preferably performed by carding the fibres. Carding may be carried out by any of the standard carding techniques involving the use of carding machines such as revolving flats cards and roller and clearer cards, the latter of which are conventionally used for carding longer staple fibres and are well known as worsted, semi-worsted and woollen cards. Preferably, however, carding is carried out by means of a stationary flat card.

Said carded fibres are optionally then formed into sheets of the required mass by unit area by bonding using any suitable bonding technique which is well known in the art, such as mechanical bonding, chemical bonding or, preferably, thermal bonding. The specific weight per unit area which is suitable for each specific application is determined by reference to parameters which necessarily include the quality of the yarn which is required to be produced and the count of the yarn. Said sheets may then be slit into strips of specified width, which can then be twisted either individually as single strips, or together as a multiplicity of strips, so as to form a yarn. In certain embodiments, thermal bonding of the web may be carried out to such a degree wherein twisting is not required, since the strips have sufficient strength for subsequent processing operations, such as weaving, knitting, and the like.

Alternatively said carded fibres may be formed into a sliver, and the subsequent process of formation of a yarn may optionally then be carried out by means of the steps of:

(i) Drawing or gilling to parallelise and intimately blend the fibres; and
(ii) Spinning or wrapping the fibres.

Preferably, said spinning operation comprises ring spinning, friction spinning, wrap spinning, or any other well known commercial spinning system.

In an alternative arrangement, the sliver formed from said carded fibres may be thermally bonded, slit into strips of specified width and twisted either individually as single strips, or together as a multiplicity of strips, so as to form a yarn, as previously described. A further option provides for the thermally bonded sliver to be formed into a thermoplastic prepreg by treatment of the sliver by means of, for example, a heated roller or a thermal environment such as an oven.

In alternative embodiments, the process of intermingling the fibres is carried out by forming a web by the process of wet-laying, whereby the carbon fibre is intermingled in a fluid, preferably aqueous, medium with at least one other fibre (a carrier fibre) and the composition is then deposited uniformly on a perforated screen or permeable substrate in order to form a sheet material of the required mass per unit area in a process similar to the Fourdrinier paper making process. The sheet so formed may have sufficient integrity to be slit into strips without any additional bonding stage; in the alternative a bonding or a bonding stage may be used. The sheets thereby formed may then be slit into strips of specified width and twisted either individually as single strips, or together as a multiplicity of strips, so as to form a yarn, in the manner previously disclosed.

In further embodiments of the invention, the production of a core yarn is envisaged, said yarn comprising a continuous or discontinuous strand of filament and/or fibres positioned to form the core of the yarn, wherein said core is surrounded by a sheath which comprises staple fibres. Therefore, the first aspect of the invention also contemplates a spun yarn comprising recycled carbon fibre, wherein said yarn comprises a core yarn. In such embodiments, the core may comprise virgin or recycled carbon fibre, whilst the sheath comprises recycled carbon fibre or recycled carbon fibre blended with a thermoplastic or other suitable fibre. Alternatively, the core may comprise a thermoplastic fibre or other reinforcing fibre. Accordingly, the method of the second aspect of the invention may be utilised for the production of a core yarn.

The recycled carbon fibre utilised in the method of the second aspect of the invention preferably consists of discontinuous virgin carbon fibre which is recycled from various sources, such as end-of-life waste and manufacturing waste.

Preferably, the spun yarn produced according to the method of the second aspect of the invention additionally includes other (matrix) fibres which preferably comprise at least one thermoplastic resin, as defined above. The recycled carbon fibre for use in this preferred embodiment can be of any length suitable for blending with the matrix fibres.

In preferred embodiments wherein said method for the production of a yarn comprising recycled carbon fibre comprises the production of yarn from blends of carbon fibre and other fibres, said production may either be achieved by initially blending these fibres together during the process of opening and blending of the fibres, or the fibres may be blended during the subsequent twisting or spinning operations.

BRIEF DESCRIPTION OF THE DRAWINGS

Embodiments of the invention are further described hereinafter with reference to the accompanying drawings, in which:

FIG. 1 is an illustration of a typical stationary flat card which is suitable for the processing of recycled carbon fibres according to the method of the second aspect of the invention;

FIG. 2 depicts the geometry of a typical feed system which is suitable for the processing of carbon fibres from various waste streams according to the method of the second aspect of the invention; and FIG. 3 shows the preferred orientation of fibres within a sliver produced by a card operating in a process according to the method of the second aspect of the invention.

DETAILED DESCRIPTION OF THE INVENTION

In preferred embodiments, the present invention provides spun yarn, and a method for the production thereof, using discontinuous recycled carbon fibre, thereby providing a product and method which are not known from the prior art.

As previously discussed, said discontinuous recycled carbon fibre typically comprises recycled virgin carbon fibre and/or reclaimed carbon fibre waste, or recyclate.

Preferred sources of recycled virgin carbon fibre include, for example, the following:

- Multi-axial trim—This is available directly from multi-axial processes without the need for cutting to length;
- Weaving selvedge—Carbon fibre may be mechanically separated from fabric selvedge either on a loom or off loom by means of a separate process;
- Extraction waste—Suction waste is available from looms and other processing equipment;
- Continuous tow—End of run remnants and part packages may be chopped to the correct length and carded as required;
- Woven fabric—Fabric can be separated from end of run, trim waste and the like, and the carbon fibres thereby recovered.

In the case of recyclate, carbon fibre is extracted from end-of-life waste materials comprising polymer matrices by means of a standard industrial process for the separation of a resin matrix from carbon fibre, which typically involves the use of at least one of a thermal treatment, treatment with solvents, use of a fluidized bed, or use of supercritical fluids.

Recycled carbon fibre which is suitable for use in the method according to the second aspect of the invention for the production of the spun yarn of the first aspect of the invention will preferably have the following features:

- Density=1.5-2.2 g/cm$^3$ (1500-2200 kg/m$^3$);
- Mean fibre length prior to processing=40-250 mm; and
- Recycled carbon fibre derived from a range of potential waste streams in both sized and unsized format.

In the method according to the second aspect of the invention, the recycled carbon fibre may be blended with other fibres prior to the carding process. These fibres may be made from natural or synthetic polymers and form part of the resin matrix in the finished composite material. Other structural reinforcing fibres may also be added, such as glass, a ceramic, a para-aramid (aromatic polyamide), and the like for the purposes of achieving specific performance attributes in the finished composite.

Carding is a key stage in a method according to the second aspect of the invention and is a well known process whereby a fibre mass of similar or dissimilar fibres can be separated into individual fibres and combined to form a filmy web that is subsequently consolidated into the form of a twistless rope, termed a card sliver.

Revolving flats cards may be employed for the processing of recycled carbon fibre. In preferred embodiments of the invention, however, stationary—or fixed—flat cards, as depicted in FIG. 1, are employed for this purpose. In such a stationary flats card, the flats are positioned at the top of the machine, between the inlet (N1) and the outlet (N2). In operation, the lap of fibres is fed to the licker-in (Q4) which reduces the mass per unit area (QL) and delivers (Q3) it to the cylinder. The cylinder and flats are covered with saw-tooth wire clothing. The rotational movement of the cylinder enables the saw-tooth wire clothing of both surfaces to individualise the fibres as the fibre mass moves to the outlet of the card. The doffer, which may also be fitted with saw-tooth wire clothing or, alternatively, may be equipped with pins, removes the individual fibres, but in the assembled form of a fibre web (i.e. card web). This web may then be consolidated into a sliver.

The action of the flats will remove some fibres to waste. Thus, although revolving flats may be used, fixed flats are preferred which may have the specification of saw-tooth wire clothing as set out in Table 1, so as to prevent accumulation of fibres between the working surfaces of the component parts. The specifications of saw-tooth wire clothing may, in practice be selected in order to suit particular matrix fibre(s) or carbon fibre variants, e.g. high strength, high modulus, pitch-based, etc.

TABLE 1

CARD WIRE SPECIFICATIONS

| Specification | Licker-in | Cylinder | Doffer | Metallic Flats |
|---|---|---|---|---|
| Tooth Height(mm) | 5.5 | 3.12 | 4.2 | 3.0 |
| Tooth Angle | 90$^0$ | 80$^0$ | 50$^0$ | 90$^0$ |
| Teeth Density | 63 | 233 | 251 | 220 |

Thus, in an alternative embodiment, the parameters relating to the cylinder are 15 degree front angle, 3.12 mm height and 394 teeth density.

Referring now to FIG. 2, there is shown the geometry of the feed arrangement to the card, i.e. the feed roller and feed plate. It is important that the relative arrangement of the feed roller and feed plate to the licker-in roller should be modified correctly so as to appropriately process carbon fibres from particular waste streams. Thus, it is important that the contact point of the licker-in with the carbon fibre is sufficiently distanced from the nip-line of the feed roller and feed plate in order to prevent shortening of fibre length or other damage to the carbon fibre.

As previously noted, various spinning systems may be utilised for processing the yarn. In addition to the systems previously specified, mention may also be made of self-twist systems, hollow spindle spinning, open end spinning, twisted tape yarns, and the like.

When using the specified carding system, wherein the cylinder is covered with a shallow saw tooth wire to assist the orientation and straightening of fibres in the machine direction (i.e. the direction of material flow), satisfactory orientation of fibres can be achieved within the sliver obtained from card. A suitable orientation is illustrated in FIG. 3. With this orientation, subsequent downstream gilling or drawing can more easily orientate the fibres in a parallel form, to give near full straightening and alignment of the fibres along the axis of the sliver.

In such drawing processes, it is possible to enhance the orientation of the carbon fibres by including heating zones in a drafting arrangement for drawing the fibres. Preferably, two heating zones are employed. The first heating and drawing zone serves to melt the resin fibres, thereby bonding together the carbon fibres with the polymer matrix whilst being drawn. On exiting the first heated zone, the material cools before entering the second heating and drawing zone, wherein the polymer is heated above its Tg (glass transition temperature) whilst being drawn.

The process is an adaptation of the melt spinning process for thermoplastic-synthetic fibres, wherein a polymer is heated to the molten state and, during extrusion, it is thinned by drawing. On subsequent cooling it enters a second heating stage, wherein it is further drawn. The purpose of this procedure is to highly align the polymer chains. It is known that, in order to align fibres, interfibre shear forces must be generated. In conventional drawing operations, this is achieved by frictional contact between fibres. However, greater shear forces can be generated in a viscous fluid media, such as the molten polymer matrix. During the drawing action, the drag of the molten viscous polymer therefore generates high shear forces which align the carbon fibres in a parallel configuration, such that the carbon fibres essentially behave in a similar way to the polymer chains.

It is possible to use the above process for direct spinning of a twistless yarn. This may be achieved by placing a false twisting device at the exit of the drafting system with a pair of delivery rollers below the false-twisting device. As the drawn material exits the drafting system it can be false-twisted to give greater compaction, in order to increase the fibre packing fraction, thereby forming a fine twistless yarn. By suitably combining the degree of drawing and false twisting, an extremely fine yarn can be made, with greater benefit for lightweight composite materials.

The spun yarn and method of the present invention display several improvements over the prior art. Thus, a method is provided for the re-use of waste carbon fibre generated from first use processing activities and reclaimed carbon fibre from end of life and finished composite materials. In addition, the delivery of value benefits to end users is facilitated by offering the opportunity to substitute virgin carbon fibre materials with staple spun yarn from recycled carbon fibre. Furthermore, the scope of market application for carbon fibre is widened through potential substitution of other lower cost reinforcing materials.

The staple spun yarn from recycled carbon fibre shows the required degree of strength and durability, and can be used in all conventional composite manufacturing operations where virgin yarn is currently employed, such as woven fabric manufacture, unidirectional fabric manufacture, filament winding, pultrusion and the like. In addition, the yarn finds application in the following applications:

- Composite applications, including aerospace, automotive, building and construction, medicine and sports products;
- Materials requiring carbon fibre for the purposes of electrical conduction, such as electrically heated textile materials; and
- Materials requiring carbon fibre for the purposes of thermal protection, such as fire barriers and protective clothing.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A wrap spun yarn comprising:

a twistless core of recycled discontinuous carbon fibre intermingled with at least one thermoplastic resin fibre; and a filament of the thermoplastic resin fibre wrapped on the twistless core as a binder.

2. The wrap spun yarn as claimed in claim 1 which additionally includes continuous carbon fibre.

3. The wrap spun yarn as claimed in claim 1 wherein said recycled discontinuous carbon fibre is obtained from at least one of virgin carbon fibre waste and reclaimed carbon fibre waste by cutting or chopping of these materials.

4. The wrap spun yarn as claimed in claim 3 wherein said virgin carbon fibre waste is derived from at least one of multi-axial fabric trim, weaving selvedge trim, fibre collected from machine extraction systems, continuous tow, woven fabric or unidirectional fabric.

5. The wrap spun yarn as claimed in claim 3 wherein said reclaimed carbon fibre waste is derived from fibre recovered from end-of-life and finished composite materials through removal of resin matrix by means of at least one of a thermal treatment, treatment with solvents, use of a fluidised bed or use of supercritical fluids.

6. The wrap spun yarn as claimed in claim 1 wherein said recycled discontinuous carbon fibre has a density of 1.5-2.2 g/cm3 (1500-2200 kg/m3).

7. The wrap spun yarn as claimed in claim 1 wherein said recycled discontinuous carbon fibre is derived from a range of potential waste streams in both sized and unsized format.

8. The wrap spun yarn as claimed in claim 1 wherein said at least one thermoplastic resin fibre is selected from polyalkenes, polyesters, polyamides, polyethersulphone polymers or high performance fibres.

9. The wrap spun yarn as claimed in claim 8 wherein said polyalkene comprises polyethylene or polypropylene, said polyester comprises polyethylene terephthalate or polybutylene terephthalate, and/or said high performance fibre comprises VECTRAN™ or a polymer from the PEEK™ range of polymers.

10. The wrap spun yarn as claimed in claim 1 wherein the recycled discontinuous carbon fibre is of any length suitable for blending with the thermoplastic resin fibre.

11. The wrap spun yarn as claimed in claim 1 wherein the recycled discontinuous carbon fibre content of the wrap spun yarn is from 0.1-99.9% by weight.

12. The wrap spun yarn as claimed in claim 1 further comprising at least one structural reinforcing fibre.

13. The wrap spun yarn as claimed in claim 12 wherein said at least one structural reinforcing fibre comprises glass, a ceramic or an aromatic polyamide.

14. A method for the production of a wrap spun yarn having a twistless core of recycled discontinuous carbon fibre intermingled with at least one thermoplastic resin fibre and a filament of the thermoplastic resin fibre wrapped on the twistless core as a binder, said method comprising the steps of:

(a) Cutting or chopping of a recycled carbon fibre material into recycled discontinuous carbon fibres;

(b) When necessary, separating the recycled discontinuous carbon fibres from other materials present in the recycled carbon fibre material;

(c) Opening and blending of the recycled discontinuous carbon fibres with thermoplastic resin fibres;

(d) Intermingling the recycled discontinuous carbon fibres and the thermoplastic resin fibres; and (e) Forming the wrap spun yarn.

15. The method as claimed in claim 14 further comprising the step of straightening the recycled discontinuous carbon fibres and thermoplastic resin fibres, this step being performed after intermingling the recycled discontinuous carbon fibres and thermoplastic resin fibres, and prior to forming a yarn.

16. The method as claimed in claim 14 wherein the process of intermingling the fibres is performed by carding.

17. The method as claimed in claim 16 wherein carded fibres are formed into a sliver.

18. The method as claimed in claim 17 wherein the process of forming the wrap spun yarn from the sliver is carried out by means of the steps of:

(i) Drawing to parallelise and intimately blend the carded fibres; and (ii) Spinning or wrapping the carded fibres.

19. The method as claimed in claim 18 wherein said spinning comprises wrap spinning, or hollow spindle spinning.

20. The method as claimed in claim 18 wherein the drawing step orientates the carded fibres in a parallel form along the axis of the sliver.

21. The method as claimed in claim 18 wherein heating zones are included in a drafting arrangement for drawing the carded fibres.

22. The method as claimed in claim 21 wherein said drafting arrangement comprises a first heating and drawing zone to melt the thermoplastic resin fibres and a second heating and drawing zone, wherein the thermoplastic resin fibres are heated above its their Tg whilst being drawn.

23. The method as claimed in claim 17 for forming a sliver wherein the carded fibres are thermally bonded and said thermally bonded sliver is formed into a thermoplastic prepreg.

24. The method as claimed in claim 17 wherein the sliver is thermally bonded and slit into strips of specified width.

25. The method as claimed in claim 16 wherein said carding is performed by means of stationary flats cards or roller and clearer cards.

26. The method as claimed in claim 25 wherein the cylinder and flats are covered with saw-tooth wire clothing.

27. The method as claimed in claim 25 wherein the card comprises a doffer which is fitted with saw-tooth wire clothing or pins.

28. The method as claimed in claim 27 wherein said doffer removes individual fibres in the assembled form of a fibre web.

29. The method as claimed in claim 25 wherein the feed arrangement to the card comprises a relative arrangement of a feed roller and a feed plate to a licker-in roller.

30. The method as claimed in claim 16 wherein carding is performed by means of a revolving flats card, a cotton card or a short-staple card which comprises flats at the top of the machine which follow a cyclic path around a cylinder.

* * * * *